US006595629B2

(12) United States Patent
Tachibana et al.

(10) Patent No.: US 6,595,629 B2
(45) Date of Patent: Jul. 22, 2003

(54) CONTINUOUS INKJET PRINTER

(75) Inventors: Yoshiaki Tachibana, Hitachinaka (JP); Takashi Shibaishi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/005,245

(22) Filed: Dec. 7, 2001

(65) Prior Publication Data

US 2002/0071010 A1 Jun. 13, 2002

(30) Foreign Application Priority Data

Dec. 8, 2000 (JP) ..... 2000-374403

(51) Int. Cl.[7] ..... B41J 2/09; B41J 2/02; B41J 2/115

(52) U.S. Cl. ..... 347/77; 347/73; 347/80

(58) Field of Search ..... 347/77, 73–74, 347/75–76, 82, 81, 53, 43, 80, 6; 438/21; 29/890.1

(56) References Cited

U.S. PATENT DOCUMENTS 3,959,797 A * 5/1976 Jensen ..... 347/53
4,107,698 A * 8/1978 Galetto et al. ..... 347/53
4,620,198 A * 10/1986 Behun ..... 347/43
5,801,734 A * 9/1998 Schneider ..... 347/77
5,848,396 A 12/1998 Gerace
5,969,324 A 10/1999 Reber et al.
5,991,735 A 11/1999 Gerace
6,029,158 A 2/2000 Bertrand et al.
6,073,127 A 6/2000 Lannert et al.
6,085,184 A 7/2000 Bertrand et al.
6,202,052 B1 3/2001 Miller

* cited by examiner

*Primary Examiner*—Lamson Nguyen
*Assistant Examiner*—K. Feggins
(74) *Attorney, Agent, or Firm*—Whitham, Curtis & Christofferson, PC

(57) ABSTRACT

Ink particles that start flying toward the printing medium P earlier than or later than the ink particles for the line central area are used as ink particles for the line ends. Accordingly, it is possible to compensate for the affects of electrical charges onto the flying path of the ink particles for the line end portions, reducing the amount of bending at the ends of the printed line such that the bend is not noticeable, thereby improving the quality of printing to satisfy consumer demands.

16 Claims, 12 Drawing Sheets

CONTINUOUS INKJET PRINTER

BACKGROUND OF THE INVENTION

1. Field of the Invention

The present invention relates to a charge deflection type continuous inkjet printer using water-based ink.

2. Description of Related Art

A conventional continuous inkjet printer has an inkjet head provided with a plurality of nozzles arranged in a single row. The inkjet head continuously ejects ink particles from the nozzles at a frequency of about 100 kHz. In a printing process for forming images on a printing medium, such as paper, which is placed in opposition to the nozzles, an electrical charge is applied to ink particles not to be printed, enabling the ink particles to be deflected and collected. On the other hand, an electrical charge is not applied to ink particles to be used in printing the images, allowing these particles to be deposited onto the printing medium.

SUMMARY OF THE INVENTION

When forming a straight line that extends parallel with the nozzle row using the continuous print head, however, the end portions of the line become unstable due to the effects of the electrical charges. More specifically, the end portions of the line are affected by an electric field applied to neighboring ink particle designated for collection. This effect causes the ink particles in the end portions to be deflected slightly during their flight. Contrarily, the center portion of the line is not affected by these electrical charges. Accordingly, ink particles in the end portions of the line fall behind those in the center portion, forming slender whisker-like deviations off the straight line.

Thus, when printing a straight line along the nozzle row direction of the print head, an electrical charge applied to ink particles at the ends of the line that are not to be printed affects neighboring ink particles intended for printing, causing the latter particles to shift slightly from their intended printing positions toward the electrical charge. This effect results in a printing phenomenon in which one or two ink particles on the ends of the line deviate from the straight line, thereby degrading the quality of printing.

The above-described problem occurs also when printing characters. Deviations invariably appear at the ends of the lines in the characters at points where the printed line portions meet unprinted portions. The resulting shape of the printed character becomes different from that of the desired original font.

In view of the foregoing, it is an object of the present invention to provide an improved continuous inkjet printer and an improved continuous inkjet printing method that is capable of eliminating the above-described degradation in printing quality.

In order to attain the above and other objects, the present invention provides a continuous inkjet printer, comprising a continuous print head, a conveying unit, a deflecting unit, a judging unit, and a control data producing unit. The continuous print head has a row of ejection nozzles. The row of ejection nozzles includes a plurality of ejection nozzles which are arranged to be located at a plurality of nozzle positions defined along a first predetermined direction. The row of ejection nozzles is located at a predetermined position along a second predetermined direction that is substantially perpendicular to the first predetermined direction. Each ejection nozzle ejects successive ink particles continuously in a third predetermined direction that is substantially perpendicular to both of the first and second predetermined directions thereby allowing the ejection nozzle row to eject successive rows of ink particles continuously in the third predetermined direction. The conveying unit conveys a printing medium relative to the continuous print head in the second predetermined direction. The deflecting unit receives successive groups or control data, and selectively deflects the ink particles in the successive ink particle rows, based an the received successive control data groups, thereby selectively preventing the ink particles from reaching the printing medium. The judging unit receives a print data group for one of the successive ink particle rows, and judges whether or not the print data group includes straight-line-end data indicative of an end portion of a straight-line that extends in the first predetermined direction. The control data producing unit produces, when the print data group is judged to include the straight-line-end data at some nozzle position, deflection control data for deflecting an ink particle at the subject nozzle position in the subject ink particle row and produces first non-deflection control data for failing to deflect a first ink particle at the subject nozzle position in a first ink particle row that is different from the subject ink particle row.

According to another aspect, the present invention provides a method of printing a straight line with the continuous inkjet printer. The method comprises the steps of: receiving a print data group for one of the successive ink particle rows; judging whether or not the print data group includes straight-line-end data indicative of an end portion of a straight-line that extends in the first predetermined direction; and producing, when the print data group is judged to include the straight-line-end data at some nozzle position, deflection control data for deflecting an ink particle at the subject nozzle position in the subject ink particle row and producing first non-deflection control data for failing to deflect a first ink particle at the subject nozzle position in a first ink particle row that is different from the subject ink particle row.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
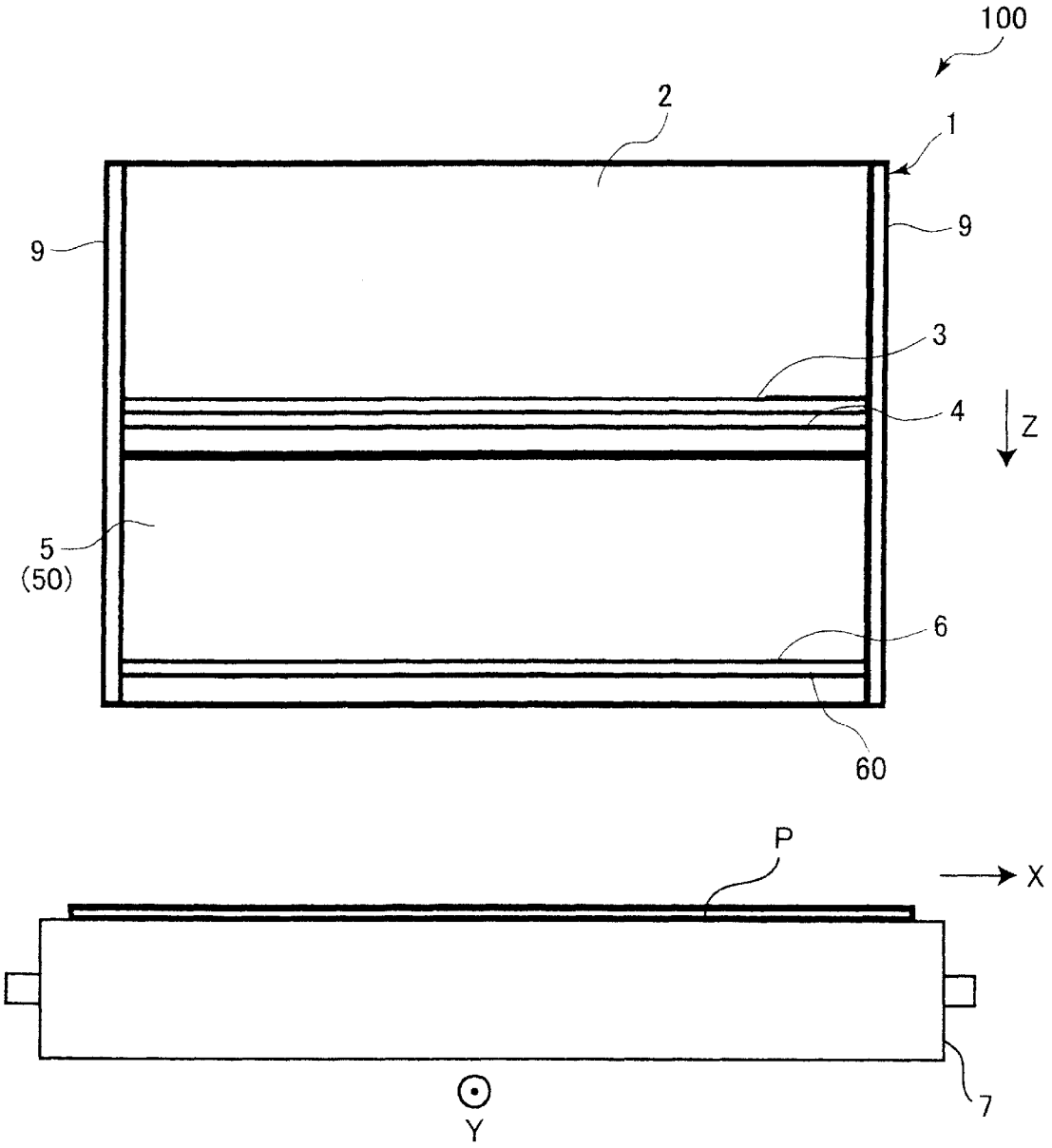
FIG. 1 in a front view showing the structure of a continuous inkjet printer according to an embodiment of the present invention.

A continuous inkjet printer and a continuous inkjet printing method according to a preferred embodiment of the present invention will be described while referring to the accompanying drawings wherein like parts and components are designated by the same reference numerals to avoid duplicating description.

Figure 2:
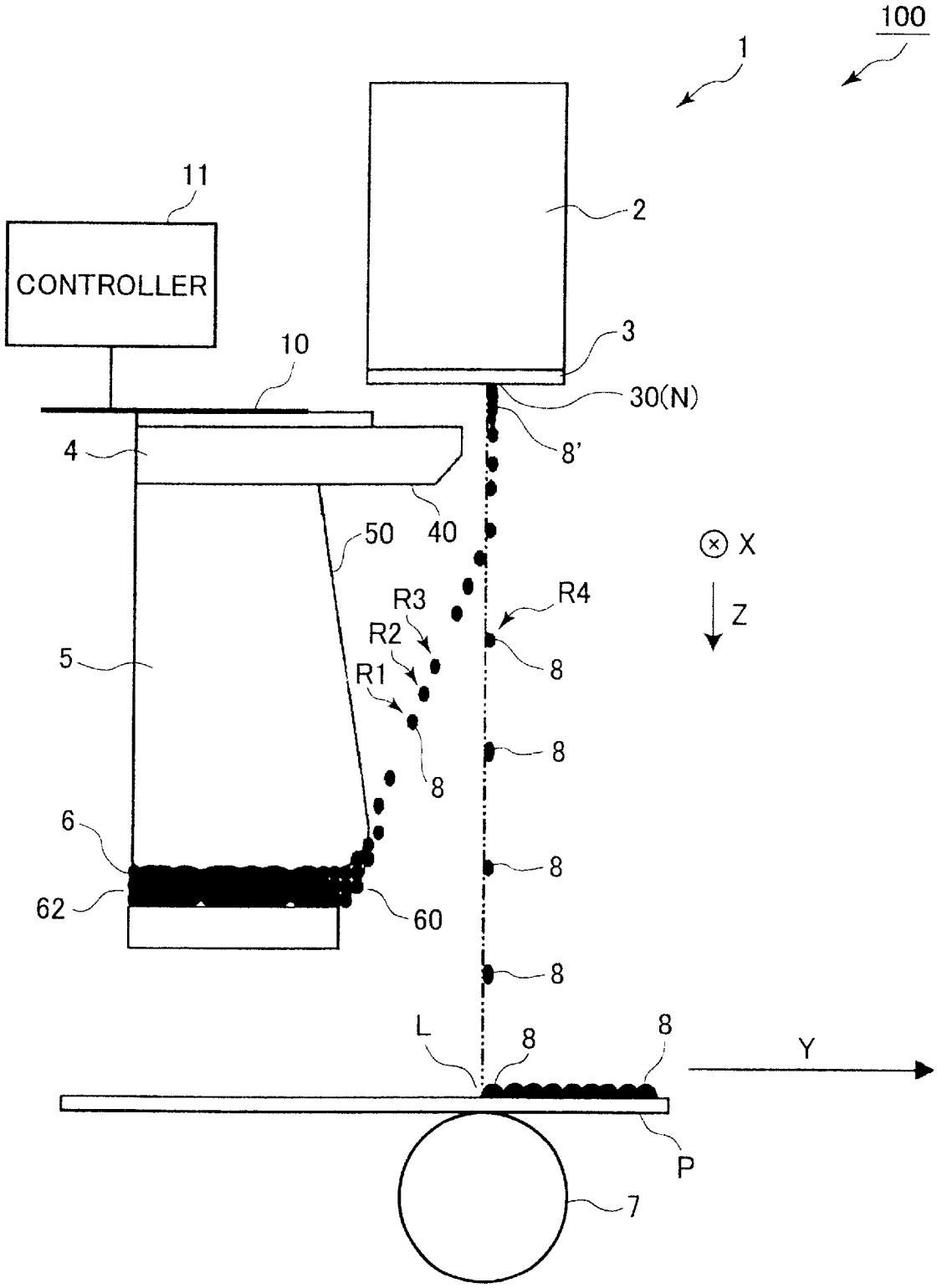
FIG. 2 is a side view showing that a continuous print head of the continuous inkjet printer of FIG. 1 performs printing operation to print a solid image on a printing medium.

FIGS. 1 and 2 are a front view and a side view showing a continuous inkjet printer 100 according to the present embodiment.

As shown in FIGS. 1 and 2, the continuous inkjet printer 100 includes: a continuous print head 1 for continuously ejecting ink particles; a conveyance roller 7 conveying a printing medium such as a paper P; and a controller 11.

The continuous print head 1 is located above the conveyance roller 7. That is, the continuous print head 1 is separated from the conveyance roller 7 by a predetermined distance in a vertical direction (Z direction, in the figure). The conveyance roller 7 is for conveying the printing medium P horizontally in a predetermined conveying direction (Y direction, in the figure).

As shown in the diagram, the print head 1 includes: a resonance ink chamber 2, a nozzle plate 3, a charge plate 4, and an ink catcher 5.

Although not shown in the drawings, the resonance ink chamber 2 includes; cm ink tank storing ink, and a piezoelectric element for applying 100-KHz ultrasonic vibrations to the ink. The nozzle plate 3 is attached to the resonance ink chamber 2. The nozzle plate 2 is formed with a plurality of (twenty-three in this example) nozzle holes 30 which are arranged horizontally in a predetermined nozzle-row direction (X direction, in the figure). The nozzle-row direction X is perpendicular to the conveying direction Y. The positions of the plurality of nozzle holes 30 define a plurality of (twenty-three in this example) nozzle positions N (N=1 to N=23), which are arranged in the nozzle-row direction X on the printing medium P. Each nozzle hole 30 has a diameter in the range of 30 to 60 micrometers. The print head 1 is positioned so that the row of nozzles 30 are located at a predetermined position L along the conveyance direction Y.

Figure 3:
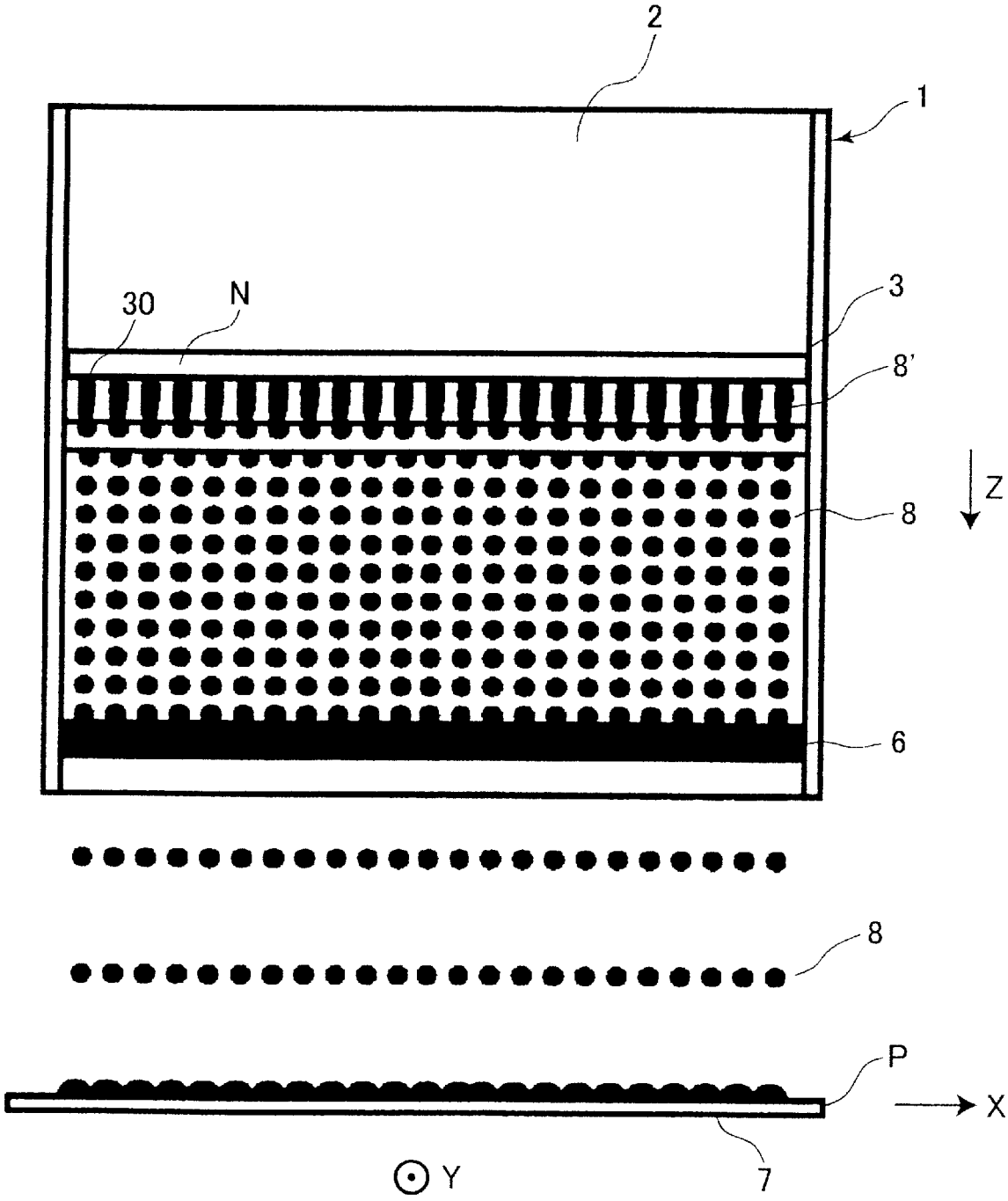
FIG. 3 is a front view showing that the continuous print head performs printing operation to print a solid image on the printing medium.

With this structure, each nozzle 30 continuously produces an ink filament 8' as shown in FIGS. 2 and 3. Because the piezoelectric element applies ultrasonic vibrations to the ink filament 8', the ink filament 8' is immediately broken into successively-flying individual ink particles 8. Because all the nozzles 30 continuously produce ink filaments 8' and because the piezoelectric element applies the same ultrasonic vibrations to all the ink filaments 8', the ink filaments 8' from all the nozzles 30 are divided into successive ink particles at the same, successive timings. Accordingly, the nozzle row, made up from all the nozzles 30, produces a plurality of rows of ink particles 8 in succession as shown in FIGS. 2 and 3. Each row of ink particles flies toward the printing medium P.

Figure 4:
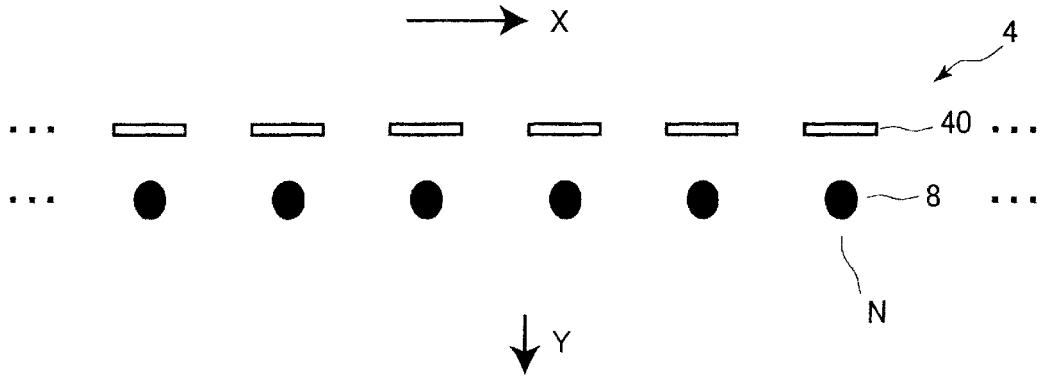
FIG. 4 is an illustrational plan view showing, from above, a charge plate in the print head of FIG. 2.

The charge plate 4 is located at a position lower than the nozzle plate 3 in the vertical direction Z and in the upstream side of the row of nozzle holes 30 (predetermined position L) in the predetermined conveying direction Y. As shown in FIG. 4, the charge plate 4 includes a plurality of (twenty-three in this example) electrodes 40 in correspondence with the plurality of nozzle holes 30 at the plurality of nozzle positions N (N=1 to N=23) Each electrode 40 is for selectively applying an electrical charge of a predetermined polarity (positive polarity, in this example) to an ink particle 8 that is ejected from a corresponding nozzle hole 30 and that is flying toward the printing medium P.

The ink catcher 5 is located at a position lower than the charge plate 4 in the vertical direction Z and in the upstream side of the row of nozzle holes 30 (predetermined position L) in the predetermined conveying direction Y. The ink catcher 5 is electrically charged to a polarity (negative polarity, in this example) opposite to the polarity, to which the charge plate 4 selectively charges the ink particles. The ink catcher 5 therefore electrostatically attracts those ink particles that are electrically charged by the charge plate 4 and that are flying toward the printing medium P. The ink catcher 5 has a smooth front surface 50 which slants vertically obliquely. When the electrically-charge particles, attracted in a direction toward the ink catcher 5 reach the front surface 50, the ink particles run down the front surface 50. Thus, the ink catcher 5 collects those electrically-charged ink particles.

An ink channel 6 is formed at the lowermost portion of the ink catcher 5. A front opening 60 of the ink channel 6 is opened on the front surface 50 at the lowermost portion of the front surface 50. A rear opening 62 of the ink channel 60 is connected to an ink supply system (not shown) via an air pump (also not shown). When the electrically-charged ink particles run down the front surface 50 and react the opening 60, the ink particles are drawn together with air by the air pump to flow through the ink channel 6 toward the rear opening 62. Thus, the ink channel 6 receives the ink particles collected by the ink catcher 5 and returns the ink to the ink supply system.

The resonance ink chamber 2, the nozzle plate 3, the charge plate 4, and the ink catcher 5 are assembled together into the continuous inkjet head 1. For example, as shown in FIG. 1, the resonance ink chamber 2, the nozzle plate 3, the charge plate 4, and the ink catcher 5 may be held between a pair of side frames 9, 9.

As shown in FIG. 2, the controller 11 is connected to the charge plate 4 via a signal line 10. The controller 11 is connected also to an external device (not shown), such as an external computer, for receiving a plurality of original print data groups in succession. The controller 11 is constructed from a computer. The controller 11 serves to add several (three, in this example) dummy groups of print data between every two successive original print data groups, thereby producing successive print data groups. The controller 11 drives the charge plate 4, based on the thus produced successive print data groups, to control the successive ink particle rows ejected from the nozzle plate 3.

It is noted that the original print data groups indicate an image desired to be formed on the printing medium P. Each of the original group of print data includes a plurality of sets of print data in correspondence with the plurality of nozzle positions N. Each set of print data is either one of dot-print data and non-dot print data. The dot-print data indicates that a dot is to be formed on the printing medium P at a corresponding nozzle position N. The non dot-print data indicates that a dot is not to be formed on the printing medium P at a corresponding nozzle position N. Bach of the dummy groups of print data includes a plurality of sets of non-dot print data in correspondence with the plurality of nozzle positions N.

Figure 5:
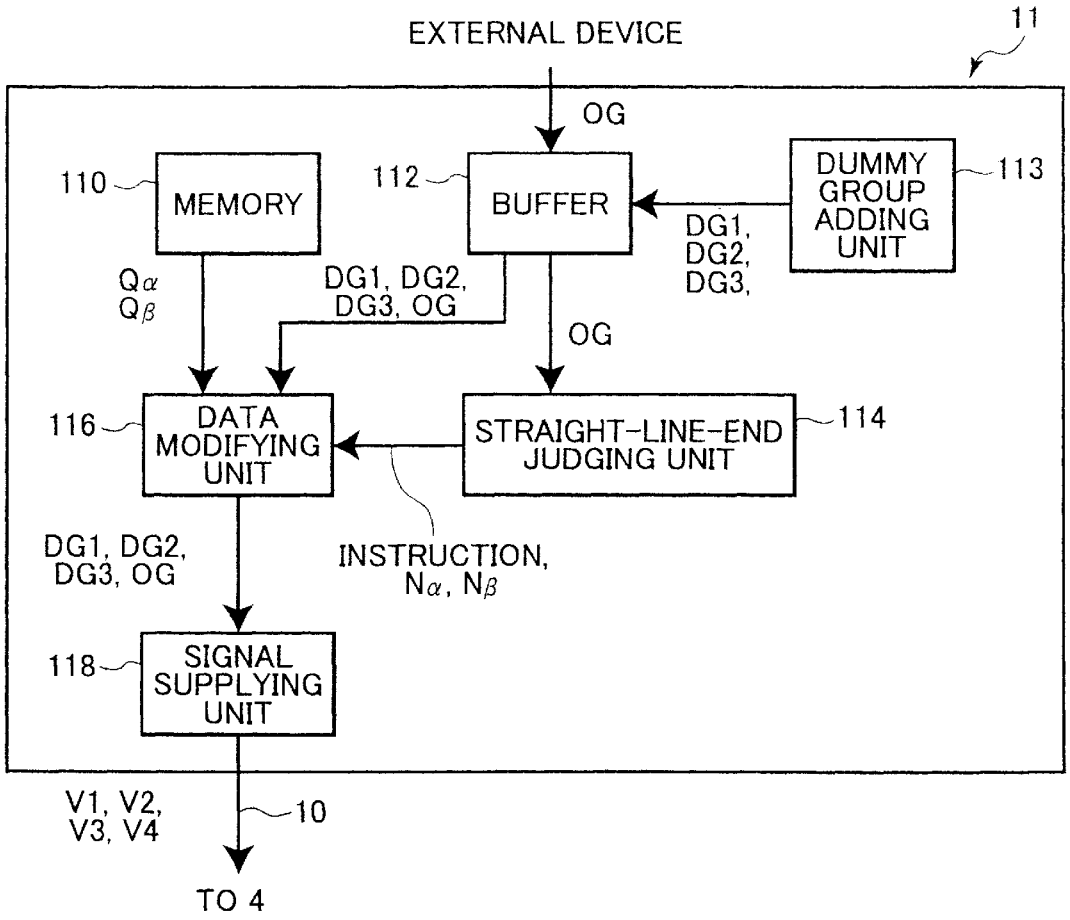
FIG. 5 is a function block diagram of a controller in the printer of FIG. 2.

As shown in FIG. 5, the controller 11 includes: a memory 110; a buffer 112; a dummy group adding unit 113; a straight-line-end judging unit 114; a data modifying unit 116; sad a signal supplying unit 118.

The memory 110 is previously set with data of a first shift amount $Q_\alpha$ (2, in this case) and data of a second shift amount $Q_\beta$ (1, in this case).

The buffer 112 is for receiving the plurality of original print data groups OG in succession from the external device.

The dummy group adding unit 113 is for adding a first dummy group DG1, a second dummy group DG2, and a third dummy group DG3 in the buffer 112 every time the buffer 112 receives one original print date group OG. Group numbers G of one (1) through four (4) are assigned to the three dummy groups DG1–DG3 and the one original group OG, respectively.

The straight-line-end judging unit 114 is for performing judging operation every time the buffer 112 completes storing the one original group OG and the three dummy groups DG1–DG3. The straight-line-end judging unit 114 judges whether or not the original group OG includes straight-line-end data (dot-print data) that is indicative of an and portion of a straight line that extends along the nozzle-row direction X. More specifically, the straight-line-end judging unit 114 judges whether or not the original group OG includes successively-arranged three or more sets of dot-print data and further includes one or more set of non-dot print data at a location directly adjacent to the three or more sets of dot-print data. If the original group OG includes no successively-arranged three or more sets of dot-print data, the judging unit 114 determines that the original group OG includes no straight-line end portion. If the original group OG includes successively-arranged three or more sets of dot-print data, but includes no set of non-dot print data at any location adjacent to the three or more sets of dot-print data, the judging unit 114 determines that the original group OG includes no straight-line end portion. When the judging unit 114 determines that the original print data group includes no straight-line end portion, the judging unit 114 outputs, to the data modifying unit 116, a non-modification instruction signal not to perform modification operation.

On the other hand, if the original group OG includes the successively-arranged three or more sets of dot-print data and one or more set of non-dot print data adjacent to the three or more sets of dot-print data, the judging unit 114 determines that the original print data group OG includes a straight-line end portion. When the judging unit 114 determines that the original print data group OG includes a straight-line end portion, the straight-line-end judging unit 114 sets, as line-end data indicative of the end portion of the straight line, one set of dot-print data that is one of the three or more sets of dot-print data and that is directly adjacent to the one or more sets of non-dot print data. The straight-line-end judging unit 114 further sets the nozzle number $N_\alpha$ indicative of the nozzle position of the line-end data. The straight-line-end judging unit 114 further sets, as next-to-end data indicative of a portion of the straight line that is next to the end portion, another set of dot-print data that is one of the three or more sets of dot-print data and that is directly adjacent to the line-end data. The straight-line-end judging unit 114 sets the nozzle number $N_\beta$ indicative of the nozzle position of the next-to-end data. The judging unit 114 outputs, to the data modifying unit 116, a modification instruction signal to perform modification operation. The modification instruction signal includes data of the nozzle numbers $N_\alpha$ and $N_\beta$.

The data modifying unit 116 retrieves, from the buffer 112, the first through dummy groups DG1–DG3 and the original group OG, upon receipt of the instruction signal (modification instruction signal or non-modification instruction signal) from the straight-line-end judging unit 114.

When the data modifying unit 116 receives the non-modification instruction signal, the data modifying unit 116 merely supplies the first through third dummy groups DG1–DG3 and the original group OG in this order (that is, the order of the group numbers G) to the signal supplying unit 118.

On the other hand, when the data modifying unit 116 receives the modification instruction signal, the data modifying unit 116 modifies the dummy groups DG1–DG3 and the original group OG, based on the data of the nozzle numbers $N_\alpha$ and $N_\beta$ and based on the data of the first and second shift amounts $Q_\alpha$ (2, in this case) and $Q_\beta$ (1, in this case) in the memory 110 in a manner described below.

The data modifying unit 116 changes the line-end data (nozzle position $N_\alpha$) in the original group OG from dot-print data into non-dot print data. The data modifying unit 116 further changes the next-to-end data (nozzle position $N_\beta$) in the original group OG from dot-print data into non-dot print data.

The data modifying unit 116 further selects the second dummy group DG2 (group number G=2) by determining the group number G=2 by subtracting the value "2" of the first shift amount $Q_\alpha$ from the group number G=4 of the original group G. The data modifying unit 116 changes, into dot-print data, non-dot print data that is located in the second dummy group DG2 at the same nozzle position $N_\alpha$ with the line-end data.

The data modifying unit 116 further selects the third dummy group DG3 (group number G=3), by determining the group number G=3 by subtracting the value "1" of the second shift amount $Q_\beta$ from the group number G=4 of the original group G. The data modifying unit 116 changes, into dot-print data, non-dot print data that is located in the third dummy group DG3 at the same nozzle position $N_\beta$ with the next-to-end data.

The data modifying unit 116 then outputs the unmodified first dummy group DG1, the modified second dummy group DG2, the modified third dummy group DG3, and the modified original group OG in this order (that is, the order of the group numbers G) to the signal supplying unit 118.

With the above-described structure, every time the buffer 112 receives one original group OG, the buffer 112 stores the original group OG. The dummy data adding unit 113 performs the adding operation to add the three (first, second, and third) dummy groups DG1–DG3 to the original group OG. The straight-line-end judging unit 114 performs the judging operation to judge whether the original group OG includes straight-line-end portion. The data modifying unit 118 selectively performs the modifying operation based on the result judged at the judging unit 114, sad outputs the selectively-modified groups DG1–DG3. OG in this order. Thus, as the buffer 112 receives the plurality of original groups OG in succession, dummy groups DG1–DG3 axe added to each original group OG, the dummy groups DG1–DG3 and the original group OG are selectively modified, and the selectively-modified groups DG1–DG3, OG are outputted in succession in a manner that the three dummy groups DG1–DG3 are outputted in this order prior to each original group OG. Accordingly, as the buffer 112 receives the plurality of original groups OG in succession, the data modifying unit 118 outputs the selectively-modified print data groups (original and dummy print data groups) to the signal supplying unit 118 in a manner that three dummy groups DG1–DG3 are outputted in this order prior to each original group OG.

As the signal supplying unit 118 receives the dummy groups DG1, DG2, and DG3, and the original group OG (group numbers G=1–4) in succession, the signal supplying unit 118 produces four successive voltage signal groups V1–V4. More specifically, every time the signal supplying unit 118 receives one group of print data (dummy group DG1, DG2, DG3, or original group OG), the signal supplying unit 118 produces one group of voltage signals. The signal supplying unit 118 produces the group of voltage signals based on the received print data group. Each voltage signal group is made up from a plurality of voltage signals in correspondence with the plurality of nozzle positions N. Each voltage signal is either one of a zero voltage signal and a negative value voltage signal. That is, the signal supplying unit 118 produces a zero voltage signal based on dot-print data, while producing a negative value voltage signal based on non-dot print data. As the signal supplying unit 118 successively receives the selectively-modified four print data groups DG1, DG2, DG3, OG, in succession, the signal supplying unit 118 successively produces the four voltage signal groups V1–V4.

The signal supplying unit 118 successively outputs the four voltage signal groups V1–V4, via the signal line 10, to the charge plate 4 in synchronization with the timings when four rows R1–R4 of ink particles 8 are ejected in succession from the nozzle plate 3 as shown in FIG. 2. Thus, the four voltage signal groups V1–V4 are supplied in succession to the charge plate 4 at the same successive timings when the four ink particle rows R1–R4 pass by the charge plate 4.

When the signal supplying unit 118 supplies one group of voltage signals to the charge plate 4, each electrode 40 is applied with a corresponding voltage signal. At some electrode that is applied with a negative value voltage signal, an electric current flows through the electrode 40. As a result, the electrode 40 applies an electrical positive charge to an ink particle that is presently passing by the electrode 40. The electrically-charged ink particle will be collected by the ink catcher 5, and will not be deposited on the printing medium P. Accordingly, a non-dot will be formed on the corresponding nozzle position N on the printing medium P.

On the other hand, at some other electrode that is applied with a zero voltage signal, no electric current flows through the electrode 40. As a result, the electrode 40 applies no electrical charges to an ink particle that is presently passing by the electrode 40. The ink particle will not be attracted by the ink catcher 5, but will fly directly toward the printing medium P, and will be deposited on the printing medium P. Accordingly, an ink dot will be formed on the corresponding nozzle position N on the printing medium P.

As the buffer 112 receives a plurality of original data groups OG in succession, the signal supplying unit 110 outputs voltage signal groups in succession. The electrodes 40 in the charge plate 4 repeatedly perform the above-described operations in response to the successively-received groups of voltage signals, while the successive rows of ink particles 8 pass by the charge plate 4 and while the conveyance roller 7 moves the printing medium P in the predetermined conveying direction Y. As a result, as shown in FIGS. 2 and 3, dot-line images, represented by the original print data groups OG, will be produced on the printing medium P.

Figure 6:
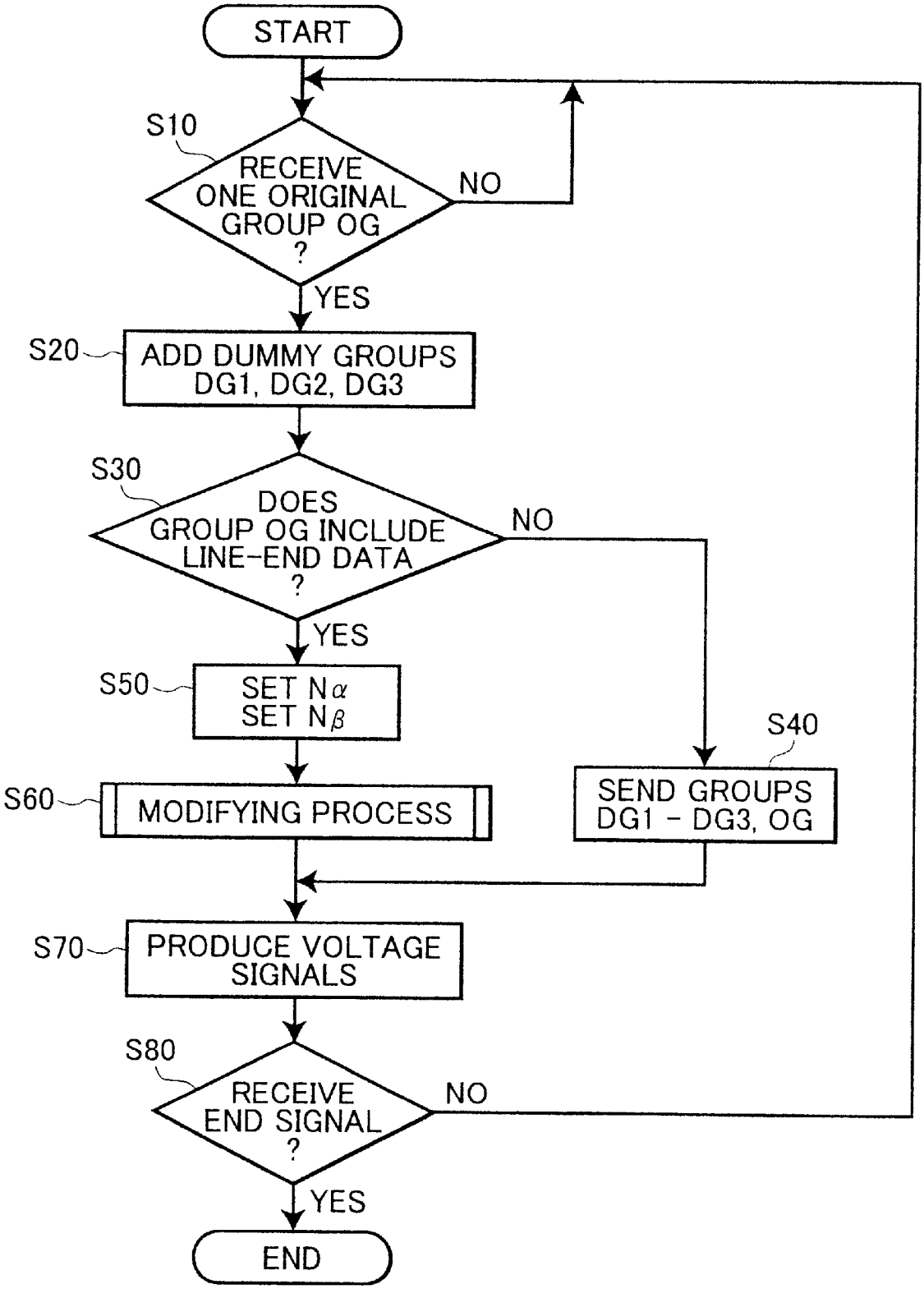
FIG. 6 is a flowchart showing the control process executed by a controller in the printer of FIG. 5.
Figure 7:
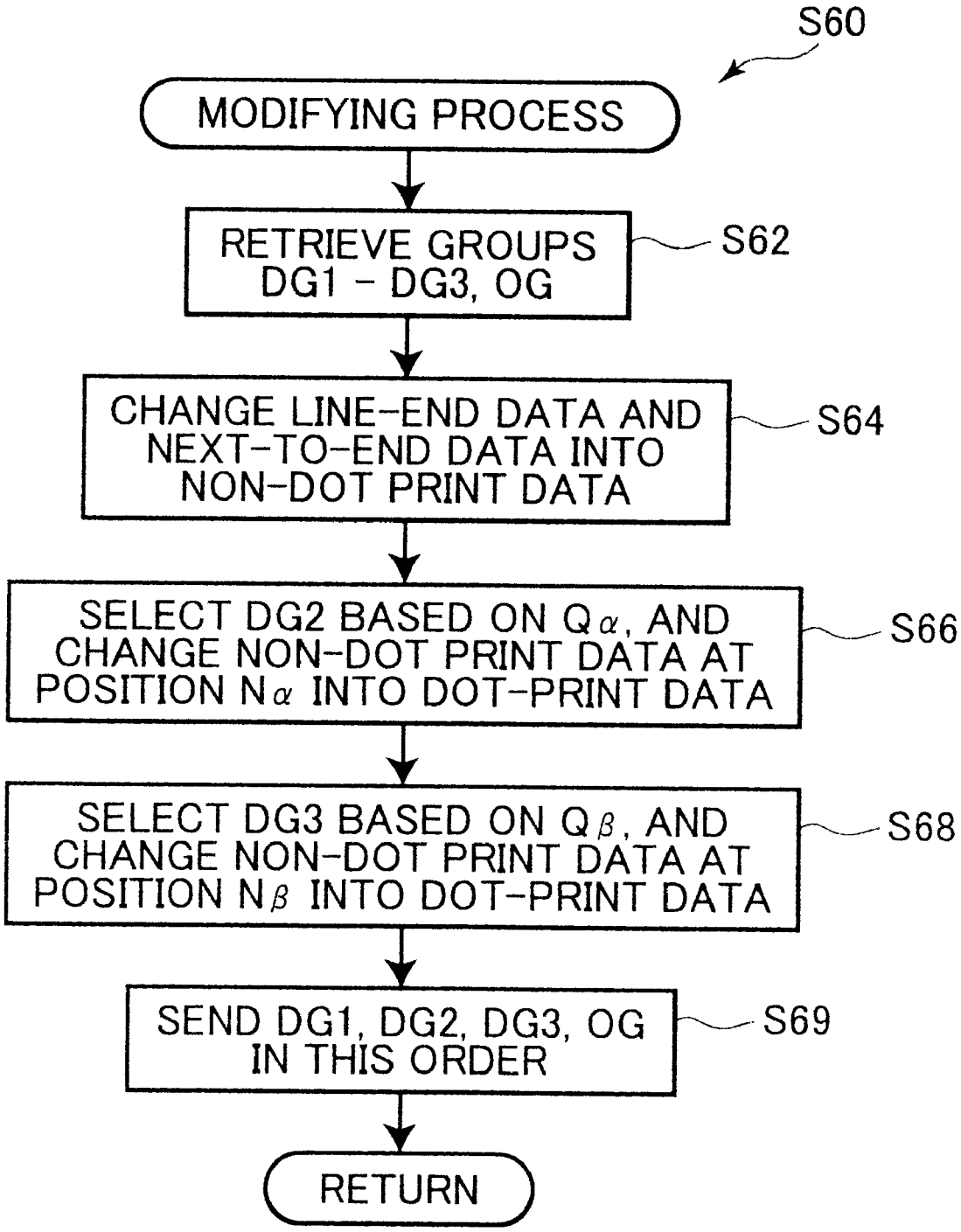
FIG. 7 is a flowchart of a modification process in the control process of FIG. 6.

With the above-described structure, the controller 11 performs control operation as shown in the flowcharts of FIGS. 6 and 7.

When the buffer 112 receives one original print data group OG from the external device (yes in S10), the dummy data adding unit 113 adds three dummy print data groups DG1–DG3 to the original group OG in S20. Then, in S30, the judging unit 114 judges whether the original group OG includes straight-line-end data by judging whether the original group OG includes three or more sets of dot-print data and one or more non-dot print data adjacent to the three or more sets or dot-print data. If the original group OG includes no straight-line-end data (no in S30), the modifying unit 116 retrieves the groups DG1–DG3 and OG from the buffer 112, and sends the groups DG1–DG3 and OG in this order to the signal supplying unit 118 without modifying the groups DG1–DG3, OG in S40. When the signal supplying unit 118 completes outputting all the groups DG1, DG2, DG3, and OG, the program proceeds to S70.

On the other hand, if the original group OG includes straight-line-end data (no in S30), the judging unit 114 sets the value $N_\alpha$ indicative of the nozzle position of the straight-line-end data, and sets the value $N_\beta$ indicative of the nozzle position of the next-to-end data in S50. Then, in S60, the modifying unit 116 performs modifying operation.

In S60, an shown in FIG. 7, the modifying unit 116 first retrieves the groups DG1–DG3 and OG from the buffer 112 in S62. The modifying unit 116 changes the straight-line-end data and next-to-end data in the group OG into non-dot print data in S64. Then, in S66, the modifying unit 116 selects the dummy group DG2 based on the value $Q_\alpha$ and changes non-dot print data at the nozzle position $N_\alpha$ in the dummy group DG2 into dot-print data. Then, in S68, the modifying unit 116 selects the dummy group DG3 based on the value $Q_\alpha$ and changes non-dot print data at the nozzle position $N_\beta$0 in the dummy group DG3 into dot-print data. The modifying unit 116 then outputs the groups DG1, DG2, DG3, OG, in this order to the signal supplying unit 118 in S69.

With reference again to FIG. 6, when the signal supplying unit 118 completes outputting all the groups DG1, DG2, DG3, OG, the program proceeds to S70.

In S70, upon receipt of the four successive groups DG1, DG2, DG3, and OG, the signal supplying unit 119 starts producing four successive voltage signal groups V1–V4. The signal supplying unit 118 outputs the voltage signal groups V1–V4 to the charge plate 4 in synchronization with the timings when four successive ink particle rows are ejected from the nozzle plate 3. As a result, ink printing is performed onto the printing medium P.

When the signal supplying unit 118 starts producing the voltage signal groups, the program proceeds to S80, where it is judged that an end signal is received from the external device. If an end signal, indicative of the end of supply of the successive original groups OG, is not yet received from the external device (no in S80), the program returns to S10 to wait for the next original group OG. On the other hand, when the end signal is received (yes in S80), this control ends.

As the routine of S10–S80 is repeatedly executed, the modifying unit 116 successively and repeatedly outputs the print data groups, in succession, to the signal supplying unit 116. The signal supplying unit 118 continues successively producing successive voltage signal groups. The signal supplying unit 118 continues outputting the successive voltage signal groups to the charge plate 4, in synchronization with the timings when successive ink particle rows are ejected from the nozzle plate 3. As a result, an ink dot image, represented by the successive original groups OG received from the external device, is printed on the printing medium P.

Having the above-described structure, the printer 1 performs printing operation as described below.

As shown in FIGS. 2 and 3, when the original print data groups OG, supplied from the external device, are indicative of a solid image of a single color, all the original print date groups OG include dot-print data only. Accordingly, the straight-line-end judging unit 114 judges that each original print data group OG includes no straight-line-end data. Accordingly, the data modifying unit 116 does not modify any original groups OG or any dummy groups DG1, DG2, or DG3. The voltage signal supplying unit 118 produces successive groups of voltage signals V1–V4, by converting all the dot-print data in each original print data group OG into zero voltage signals and converting all the non-dot-print data in each of the dummy print data groups DG1–DG3 into negative value voltage signals. Accordingly, the charge plate 4 repeatedly controls the ink particle rows R1–R4, which are successively ejected from the nozzle plate 3, based on the successive groups of voltage signals V1–V4. That is, when receiving one group of voltage signals V1 that is produced based on one dummy print data group DG1, the charge plate 4 performs charging operation to electrically charge all the ink particles in the corresponding ink particle row R1 that is presently passing by the electrodes 40. On the other hand, when receiving one group of voltage signals V4 that is produced based on one original print data group OG, the charge plate 4 performs non-charging operation not to electrically charge the ink particles in one ink particle row R4 that is presently passing by the electrodes 40.

Figure 8:
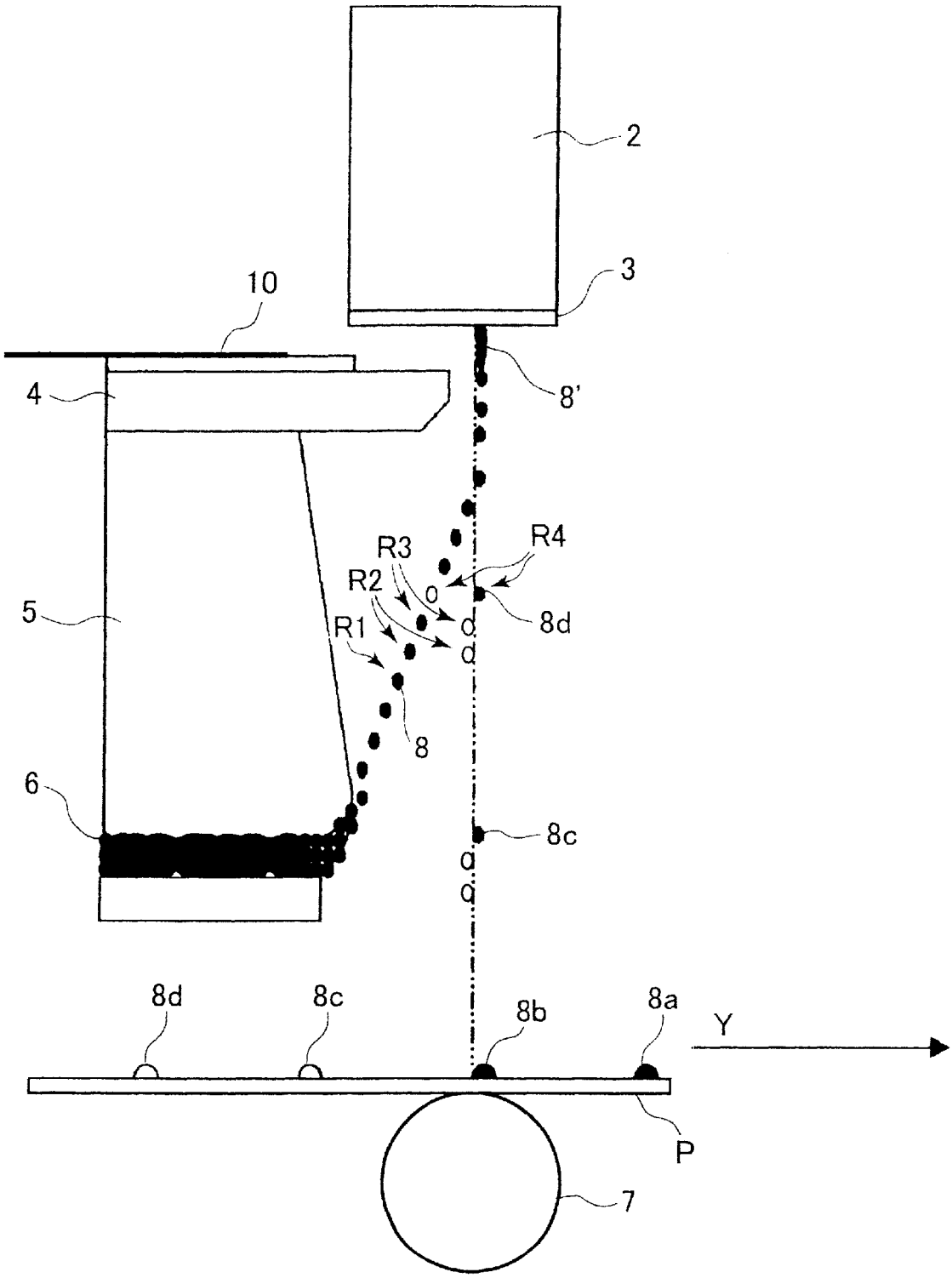
FIG. 8 is a side view showing that the continuous print head performs printing operation to successively print a plurality of straight lines on the printing medium at desired intervals.
Figure 9:
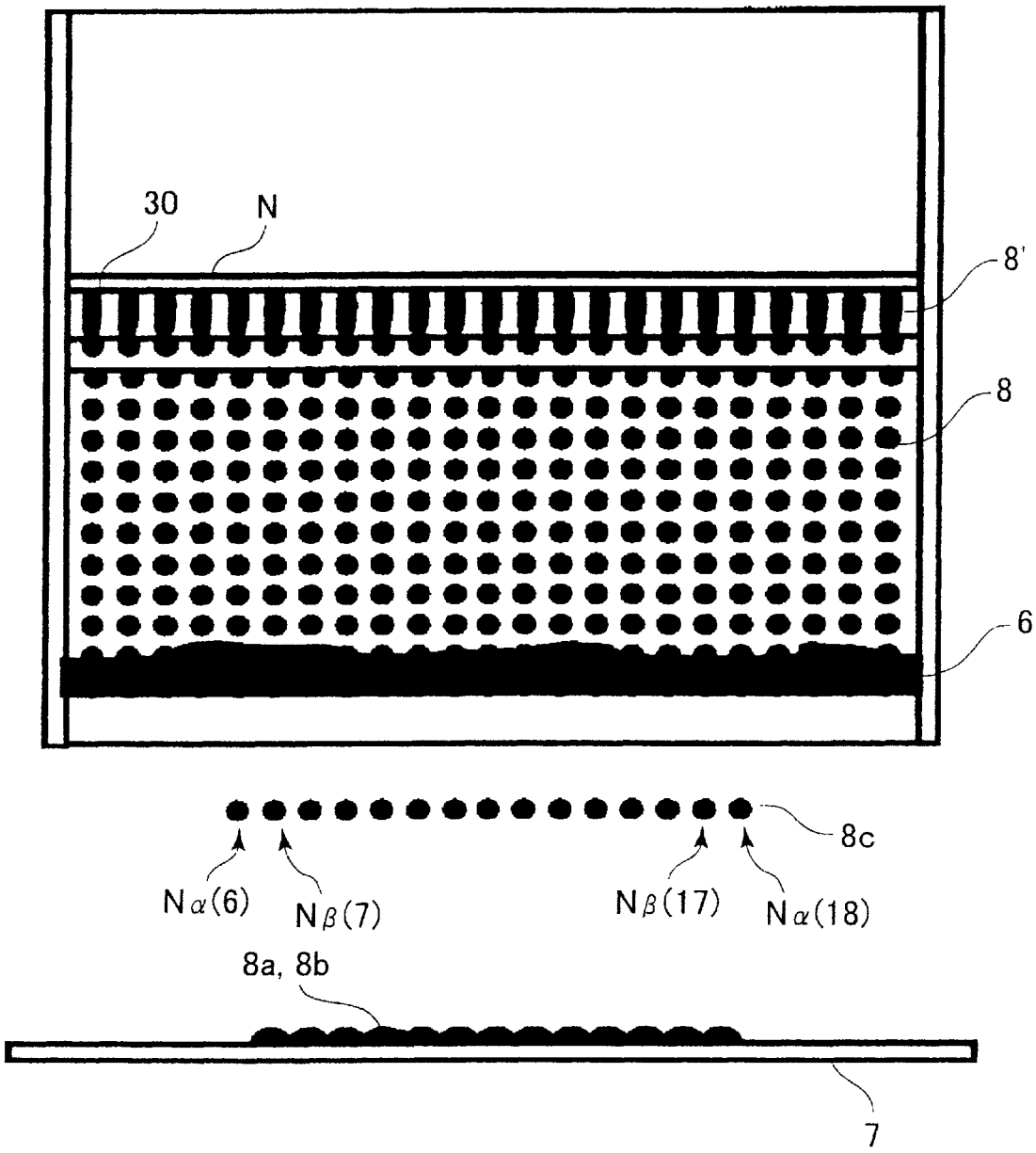
FIG. 9 is a front view showing that the continuous print head performs printing operation to successively print a plurality of straight lines on the printing medium.

As shown in FIGS. 8 and 9, it is now assumed that the plurality of original print data groups OG are prepared to print straight lines of a predetermined length on the printing medium P at desired intervals. Each straight line extends along the nozzle-row direction X over the length that is defined between sixth and eighteenth nozzle is positions (N=6 to N=18). In this case, the original print data group OG for printing one straight line is constructed from: five successive non-dot print data (for first through fifth nozzle positions (N=1 to N=5)), thirteen successive dot-print data (for sixth through eighteenth nozzle positions (N=6 to N=18)), and five successive non-dot print data (for nineteenth through 23-th nozzle positions (N=19 to N=23)).

Accordingly, when the original print data group OG for printing the straight line is received by the buffer 112, the straight-line-end judging unit 114 judges that the original group OG includes straight-line-end data. The straight-line-end judging unit 114 determines that straight-line-end data is located on the nozzle positions $N_\alpha$=6 and $N_\alpha$=18 and that next-to-end data is positioned on the nozzle positions $N_\beta$=7 and $N_\beta$=17. The straight-line-end judging unit 114 outputs a modification instruction signal to the modifying unit 116. The modification instruction signal includes; data indicative of the nozzle numbers $N_\alpha$ of "6" and "18", and data indicative of the nozzle numbers $N_\beta$ of "7" and "17".

Upon receipt of the modification instruction signal, the data modifying unit 116 changes, into non-dot print data, the straight-line-end data in the original group OG at the nozzle positions $N_\alpha$ of "6" and "18", and also changes, into non-dot print data, the next-to-end data in the original group OG at the nozzle positions $N_\beta$ of "7" and "17". The date modifying unit 116 further changes, into dot-print data, non-dot print data in the dummy print data group DG3 at the nozzle numbers $N_\beta$ of "7" and "17". The data modifying unit 116 also changes, into dot-print data, non-dot print data in the dummy print data group DG2 at the nozzle numbers $N_\alpha$ of "6" and "18".

Thus, in the data modifying unit 116, the first dummy group DG1 is not modified, and therefore maintains to have non-dot-print data at all the nozzle positions N. The second dummy group DG2 is modified to have dot-print data at nozzle positions $N_\alpha$ of "6" and "18" and non-dot-print data at all the other remaining nozzle positions. The third dummy group DG3 is modified to have dot-print data at nozzle positions $N_\beta$ of "7" and "17" and non-dot-print data at all the other remaining nozzle positions. The original group OG is modified to have dot-print data between nozzle positions "8" and "16" and non-dot print data at all the other remaining nozzle positions. The data modifying unit 116 outputs, to the signal supplying unit 118, the first dummy group DG1, the second dummy group DG2, the third dummy group DG3, and the original group OG, in this order. Upon receipt of the four print data groups DG1–DG3 and OG, in this order, the voltage signal supplying unit 118 supplies four successive voltage signal groups V1–V4 to the charge plate 4, in synchronization with the timings when the nozzle plate 3 ejects four successive ink particle rows R1–R4.

In this example, as shown in FIGS. 8 and 9, upon receipt of one original group OG for printing each of straight lines 8*a*, 8*b*, 8*c*, and 8*d*, the controller 11 outputs four successive groups of voltage signals V1–V4 in synchronization with the timings when the nozzle plate 3 ejects four successive ink particle rows R1–R4. It is noted that the figures show the time when the straight lines 8*a* and 8*b* have already been printed on the printing medium P, while straight lines 8*c* and 8*d* are about to be printed next.

Next, a comparative example will be described with reference to FIGS. 10 and 11.

In this comparative example, the straight-line-end judging unit 114 or the data modifying unit 116 (S30, S50, S60) is not provided in the controller 11. In this case, the signal supplying unit 118 merely produces a plurality of voltage signal groups V1–V4 based an the plurality of print data groups (the dummy data groups DG1–DG3 and original print data group OG) in S40. Accordingly, upon receipt of one original group OG for printing one straight line 8*a*, 8*b*, 8*c*, or 8*d*, the electrodes 40 at the nozzle positions "6" to "18" are applied with no electric voltages, while the electrodes 40 at the nozzle positions "1" to "5" and at the nozzle positions "19" to "23" are applied with negative electric voltages.

Figure 10:
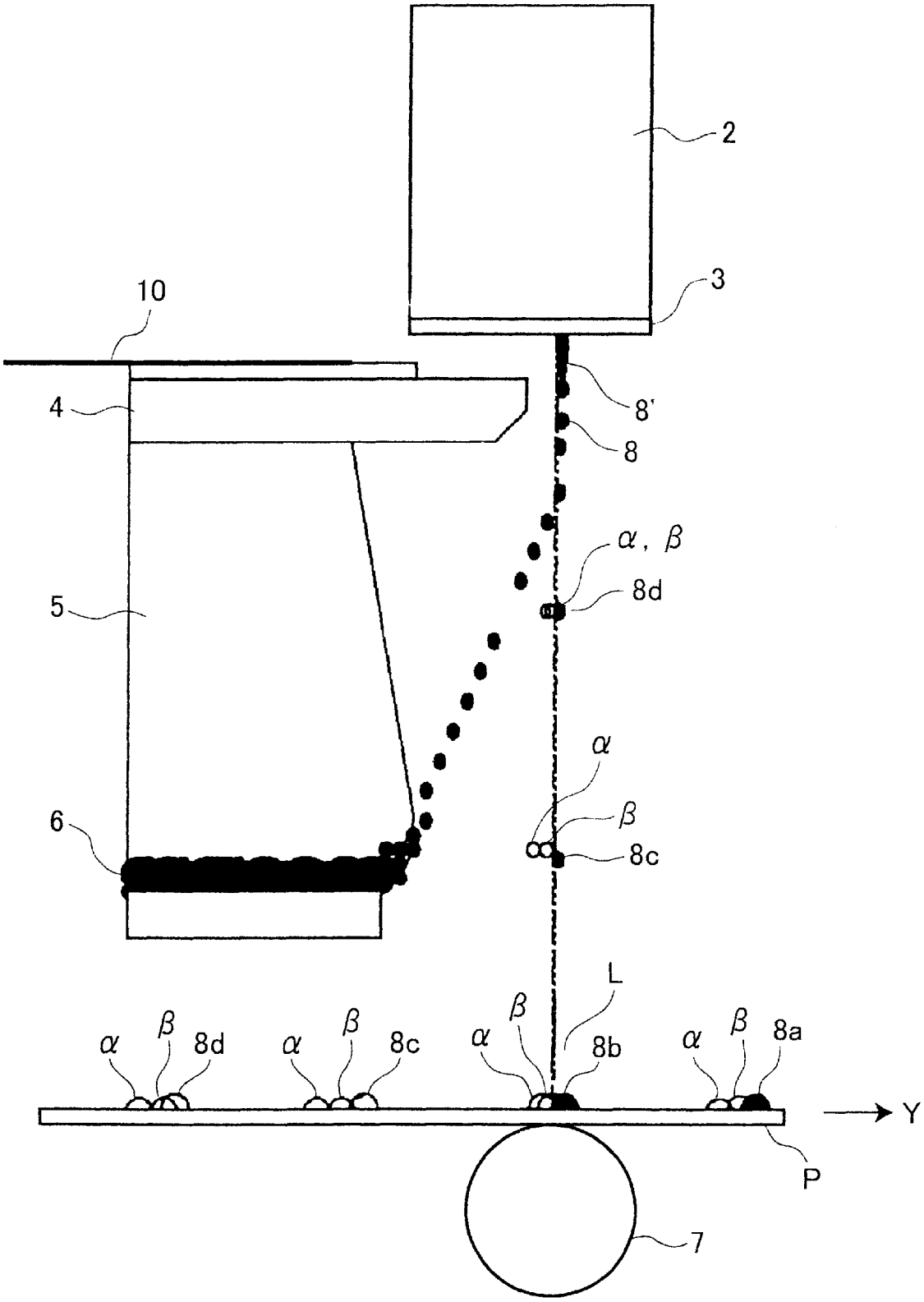
FIG. 10 is an explanatory side view showing how ink particles fly toward a printing medium to print straight lines with bending ends according to a comparative example.
Figure 11:
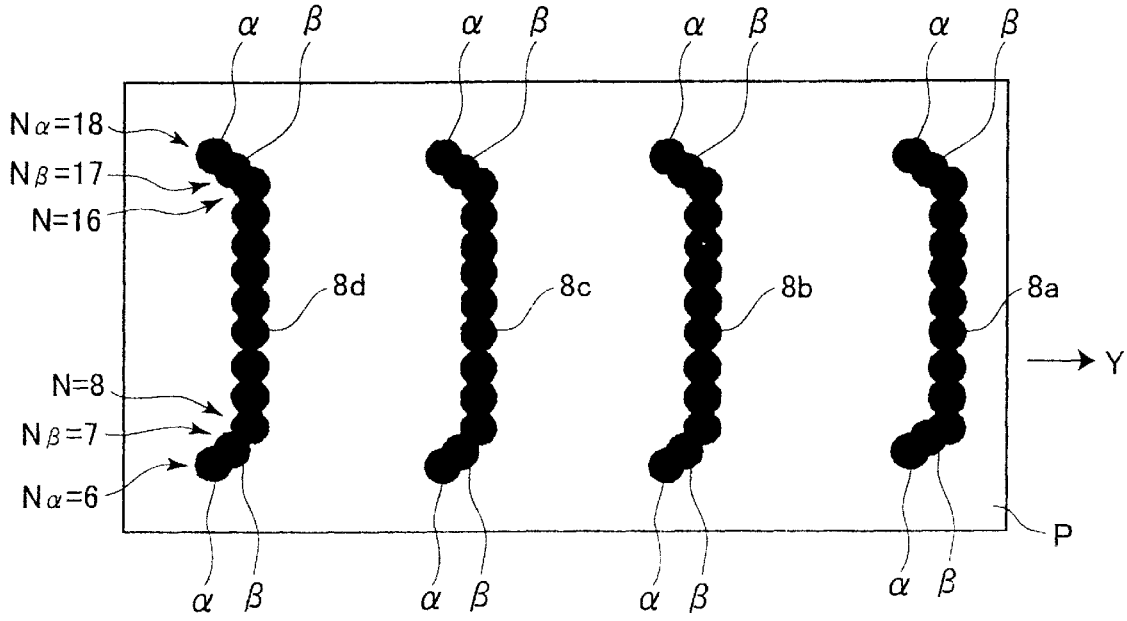
FIG. 11 is an explanatory diagram showing the printed results when straight lines with bending ends are printed according to the comparative example.

According to this comparative example, however, the end portions of each straight line 8*a*, 8*b*, 8*c*, or 8*d*, formed on the printing medium P, erroneously deviate from the desired straight line condition, as shown in FIGS. 10 and 11. More specifically, line-end ink particles α at the nozzle positions $N_\alpha$ of "6" and "18" are deviated by a first deviation amount in a direction opposite to the conveying direction Y from the ink particles at the nozzle positions N of "8"–"16". Next-to-end ink particles β at the nozzle positions $N_\beta$ of "7" and "17" are also deviated by a second deviation amount in a direction opposite to the conveying direction Y from the ink particles at the nozzle positions N of "8"–"16". The second deviation amount is slightly smaller than the first deviation amount.

This printing results occur because the ink particles α and β at nozzle positions $N_\alpha$, $N_\beta$ of "6" and "7" are slightly charged by the neighboring charging plates 40 at the nozzle positions N of "5"–"1" and because the ink particles α and β at nozzle positions $N_\alpha$, $N_\beta$ of "17" and "18" are slightly charged by the neighboring charging plates 40 at the nozzle positions "19"–"23".

Figure 12:
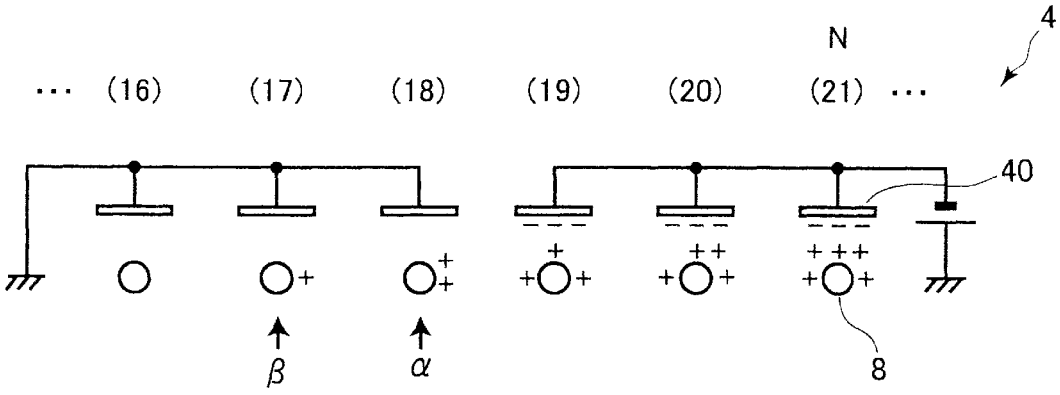
FIG. 12 is an illustrational plan view showing how electrodes in the charge plate charges ink particles.

This phenomenon will be described in more detail with reference to FIG. 12.

It is noted that in this figure, only the electrodes 40 at nozzle positions N of "16"–"21" are shown. As apparent from this figure, even though the electrodes 40 at nozzle positions N of "17" and "18" are applied with no electric voltages, the ink particles α and β at the nozzle positions "17" and "18" are slightly charged by the electric potentials, which are developed on the electrodes 40 at the neighboring nozzle positions "19"–"23".

Thus, due to the effects of the electric potential of the electrodes 40 at the nozzle positions "19"–"23", ink particles α and β, which are positioned at the nozzle positions "17" and "18", are slightly charged. The thus slightly-charged ink particles α and β are attracted slightly in a direction toward the charge plate 4 and the ink catcher 5, while they are flying toward the printing medium P. Because the charge plate 4 and the ink catcher 5 are located in the upstream wide of the nozzle holes 30 in the conveyance direction Y, the slightly-charged ink particles α and β reach the printing medium P at locations that are slightly shifted backwardly (that is, in the direction opposite to the conveyance direction Y) from the location L, which is exactly below the row of nozzles 30 and at which the non-charged particles properly reach the printing medium P, as shown in FIG. 10. As a result, the lines are printed irregularly at their opposite end portions as shown in FIG. 11. It is noted that the particles α and β are not collected by the catcher plate 5 because the amounts of charges inducted thereon are too little to be deflected by the catcher plate 5 completely away from the printing medium P.

It is also noted that the ink particle α is located at a position that is directly adjacent to the charged electrode 40 at the nozzle position "19". The ink particle β flies adjacent to the ink particle α, but is indirectly adjacent to the charged electrode 40 at the nozzle position "19". The distance between the ink particle β and the electrode 40 at the nozzle positions "19" is about two times as long as the distance between the ink particle α and the electrode 40 at the nozzle position "19". It is noted that the amounts of charges induced on an ink particle is generally proportional to the reciprocal of the power of the distance between the ink particle and a charged electrode. Accordingly, the charge amount induced on the ink particle α is about four times as large as the charge amount induced on the ink particle β. Accordingly, the deviation amount, by which the ink particle α is deviated from the proper position L, to greater than the deviation amount, by which the ink particle β is deviated from the proper position L. Thus, the ink particle α is shifted farther toward the ink catcher 5 than the ink particle β. Hence, a straight line with bent ends is obtained as shown in FIGS. 10 and 11.

It is noted that the distance between an ink particle at the nozzle position "16" and the electrode 40 at the nozzle positions "19" is about three times as long as the distance between the ink particle α and the electrode 40 at the nozzle position "19". Accordingly, the charge amount induced on the ink particle at the nozzle position "16" is about one ninth of the charge amount induced on the ink particle α. Accordingly, the deviation amount, by which the ink particle at the nozzle position "16" is deviated from the proper position L, is too small to be visually observed as shown in FIG. 11. Hence, it is sufficient to correct only the deviations of the ink particles α and β.

Figure 13:
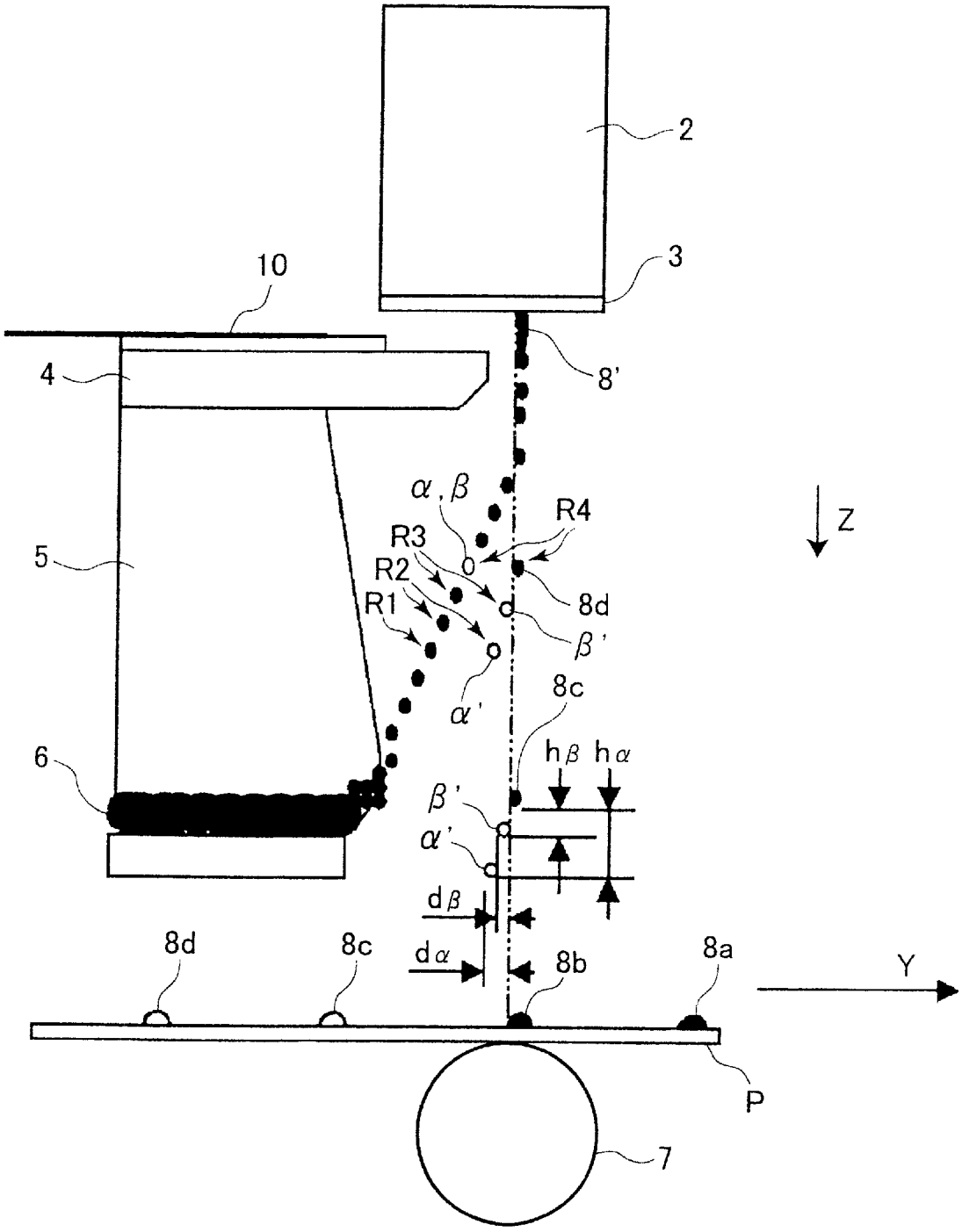
FIG. 13 is an explanatory side view showing how ink particles fly toward a printing medium to print straight lines with no bending ends according to the present embodiment.
Figure 14:
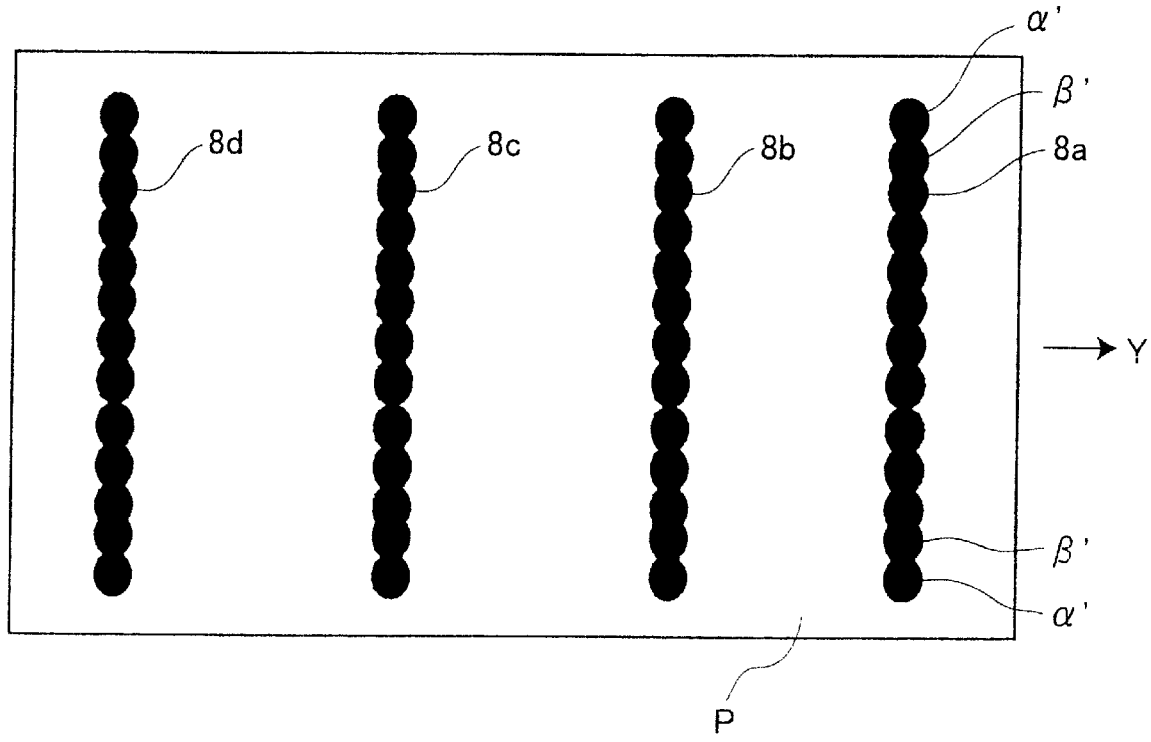
FIG. 14 is an explanatory diagram snowing the printed results when straight lines with no bending ends are printed according to the present embodiment.

With reference to FIGS. 13 and 14, next will be described the mechanism how the present embodiment solves the above-described problems of the comparative example.

When the buffer 112 receives one original print data group OG for printing one of the straight lines 8*a*–8*d* in FIGS. 8 and 9, the judging unit 114 judges that the original group OG includes straight-line-end data and next-to-end data at the nozzle positions $N_\alpha$ (=6 and 18) and $N_\beta$ (=7 and 17), respectively. In this case, the dot-print data, in the original group OG, at nozzle positions N of "8"–"6", indicate the central area of the straight line.

According to the present embodiment, the modifying unit 116 does not modify or change the dot-print data at the nozzle positions N of "8"–"16" in the original group OG. The signal supplying unit 118 converts the dot-print data in the original group OG into zero voltage signals in the voltage signal row V4. The zero voltage signals in the voltage signal row v4 are used to control corresponding ink particles in the corresponding ink particle row R4 to reach the printing medium P as shown in FIG. 13.

On the other hand, the modifying unit 116 modifies the line-end data and the next-end data in the original group OG into non-dot print data. The signal supplying unit 118 converts the non-dot print data into negative-value voltage signals in the voltage signal row V4. The negative-value voltage signals in the voltage signal row V4 are used to deflect the ink particles α and β in the corresponding ink a particle row R4 so as not to reach the printing medium P but to be collected by the catcher plate 5.

Instead, the modifying unit 115 selects the dummy data group DG3 by determining the group number G=3 by subtracting the first shift amount $Q_\beta$ (1) from the group number G=4 of the original group OG. The modifying unit 116 modifies non-dot print data in the dummy group DG3, at the same nozzle positions with the next-to-end positions $N_\beta$ of the ink particles β, into dot-print data. The signal supplying unit 118 converts the dot-print data into zero voltage signals in the voltage signal row V3. The zero voltage signals in the voltage signal row V3 are used to control ink particles β' at the next-to-end positions $N_\beta$ in the ink particle row R3 to reach the printing medium P.

Additionally, the data modifying unit 116 selects the dummy data group DG2 by determining the group number G=2 by subtracting the first shift amount $Q_\alpha$ (2) from the group number G=4 or the original group OG. The data modifying unit 116 modifies non-dot print data in the dummy group DG2, at the same nozzle positions with the straight-line-end positions $N_\beta$ of the ink particles α, into dot-print data. The signal supplying unit 118 converts the dot-print data into zero voltage signals in the voltage signal row V2. The zero voltage signals in the voltage signal row V2 are used to control ink particles α' at the line-end positions $N_\alpha$ in the ink particle row R2 to reach the printing medium P.

It is noted that the dummy print data group DG3 includes dot-print data only at the next-to-end positions $N_\beta$, and includes non-dot print data at all the remaining nozzle positions. Similarly, the dummy print data group DG2 includes dot-print data only at the line-end portions $N_\beta$, and includes non-dot print data at all the remaining nozzle positions. Accordingly, the ink particle α' and β' are slightly charged by neighboring electrodes that are charged for the non-dot print data. The ink particles α' and β' are therefore slightly deflected in the direction opposite to the conveying direction Y. In this example, as shown in FIG. 13, the ink particles α' and β' are slightly deflected by the deflection amounts $d_\alpha$ and $d_\beta$ in the direction opposite to the conveying direction Y. However, the ink particles α' and β' in the ink particle rows R2 and R3 reach the printing medium P earlier than the ink particles in the ink particle row R4. That is, the ink particles α' and β' in the ink particle rows R2 and R3 advance by the amounts $h_\alpha$ and $h_\beta$ in the downward direction Z relative to the ink particles in the ink particle row R4. According to the present embodiment, the values $d_\alpha$ and $d_\beta$ and the values $h_\alpha$ and $h_\beta$ of the ink particle α' and β' in the ink particle rows R2 and R3 satisfy, with respect to the printing medium conveying speed, a condition that the ink particle α' and β' can reach the printing medium P at the same line position with the ink particles in the ink particle row R4. Accordingly, a straight line with no bending ends are printed as shown in FIG. 14.

It is noted that according to the present embodiment, as described above, the data modifying unit 116 selects, as a group for producing the modified end ink particle α', the dummy data group DG2, by determining the group number G=2 by subtracting the first shift amount $Q_\alpha$ (2) from the group number G=4 of the original group OG. The data modifying unit 116 further selects, as a group for producing the modified end ink particle β', the dummy data group DG3 by determining the group number G=3 by subtracting the first shift amount $Q_\beta$ (1) from the group number G=4 of the original group OG. According to the present embodiment, when the ink jet printer 1 is manufactured and before the ink jet printer 1 is shipped out, experiments are actually conducted to repeatedly print straight lines, while changing the shift amounts $Q_\alpha$ and $Q_\beta$ among values of one (1), two (2), and three (3) to control the data modifying unit 116 to select, based on the changed shift amounts $Q_\alpha$ and $Q_\beta$, dummy groups for producing the modified end ink particles α' and β' among the three dummy groups DG1–DG3. Based on the experimental results, it is determined which dummy groups, defined by the shift amounts $Q_\alpha$ and $Q_\beta$, can provide the values $h_\alpha$ and $h_\beta$ and $d_\alpha$ and $d_\beta$ that attain the most suitable straight line. Then, the memory 110 is set with data of the shift amounts $Q_\alpha$ and $Q_\beta$ that provide the most suitable straight line. In the above-described example, the shirt amounts $Q_\alpha$ and $Q_\beta$ are set to "2" and "1".

Thus, according to the present embodiment, the controller 11 controls the charge plate 4 to use ink particles that pans by the charge plate 4 at properly-controlled timings to print one straight line. More specifically, in order to print the central area of each straight line, the charge plate 4 uses ink particles in one ink particle row that passes by the charge plate 4 at some timing. In order to print the end portions of each straight line, however, the charge plate 4 use ink particles in other ink particle rows that pass by the charge plate 4 at timings prior to the timing when the ink particle row used for printing of the central area passes by the charge plate 4. Accordingly, ink particles for the line end portions reach the printing medium P prior to ink particles for the line central area. However, because the ink particles for the line end portions are slightly charged and because the ink particles for the line central area are not charged, they can reach the printing medium P at the same line position with respect to conveyance direction Y.

Because the printing medium P is moving in the conveyance direction Y while ink particles are flying toward the printing medium P, by allowing the ink particles α' and β' for the line end portions to reach the printing medium P earlier than the remaining ink particles for the line central portion, correction can be performed in coordination with the movement of the printing medium P. With this method, it is possible to eliminate deviation at the ends of the printed lines, thereby improving the quality of printing.

Thus, by selecting, as ink particles α' and β' for the line end portions, ink particles that start flying toward the printing medium P earlier than the remaining ink particles, it is possible to allow those slightly-charged ink particles α' and β' to reach the printing medium P at the same locations relative to the conveyance direction Y with the remaining non-charged particles. It is possible to reduce the amount of bending at the ends of a printed line until the bend is not as noticeable, or until there is completely no deviation.

The above description is related to the case where original print data indicate straight lines parallel to the row of nozzles. However, the original print data may indicate a character. If the character includes straight lines parallel to the row of nozzles 30, according to the comparative example having no judging unit 114 or no modifying unit 116, the end portions of the straight lines will deviate in the same way described above, resulting in the printing of distorted characters. It is therefore conceivable to process the font data of the character, before converting the font data into the print data, in order to adjust the end portions of character lines parallel to the row of nozzles and reduce bends in these end portions. However, this font processing can become considerably complex when treating the sane characters in different orientations, such as the same character to be printed parallel to and perpendicular to the nozzle row. It becomes possible to attain more accurate, but more simple printing not by processing the font data, but by performing the correction operation according to the present embodiment to correct two dots at the ends of lines in characters that extend parallel to the nozzle rows.

<First Modification>

Next will be described a first modification of the present embodiment.

In the present embodiment, both of the straight-line-end data and next-to-end data are corrected in order not to print both of the ink particles α and β. However, only the straight-line-end data may be corrected when the deviation amount of the next-to-end ink particle β is too little to be observed visually.

<Second Modification>

Next will be described a second modification of the present embodiment.

In the above-described embodiment, the charge plate 4 and the ink catcher 5 are located in the upstream side (left side in FIG. 2) of the row of nozzles 30 in the conveyance direction Y. Accordingly, by selecting, as ink particles α' and β' for the line end portions, ink particles that start flying toward the printing medium P earlier than the remaining ink particles, it is possible to allow those slightly-charged ink particles α' and β' to reach the printing medium P at the same locations relative to the conveyance direction Y with the remaining non-charged particles.

Contrarily, according to this modification, the charge plate 4 and the ink catcher 5 are located in the downstream side (right side, in FIG. 2) of the row of nozzles 30 in the conveyance direction Y.

In this modification, it is necessary to select, an ink particles α' and β' for the line end portions, ink particles that start flying toward the printing medium P later than the remaining ink particles for the line central area. By doing such a selection, the slightly-charged ink particles α' and β' can reach the printing medium P at the same locations relative to the conveyance direction Y with the remaining non-charged particles.

More specifically, also according to this modification, the dummy data adding unit 113 adds first through third dummy groups of print data DG1–DG3 every time the buffer 112 receives one original group of print data OG. In this modification, however, the group numbers or the original group OG and the dumb groups DG1–DG3 are set as "1" to "4", respectively, in order to indicate that the dummy groups DG1–DG3 are added after the original group OG. If the straight-line-end judging unit 114 determines that the original group OG includes line-end data at nozzle position $N_\alpha$ and next-to-end data at nozzle position $N_\beta$, the data modifying unit 116 changes the line-end data and the next-to-end data into non-dot print data, in order not to print the ink particles α and β for the end portions. The data modifying unit 116 further selects the second dummy group DG2 by determining group number G=3 by adding the shift amount $Q_\alpha$ ("2" in this example) to the group number G=1 or the original group OG. The data modifying unit 116 changes non-dot print data, in the dummy group DG2 at the nozzle position $Q_\alpha$, into dot-print data for printing the corrected end ink particle α'. The data modifying unit 116 further selects the first dummy group DG1 by determining the group number G=2 by adding the shift amount $Q_\beta$ ("1" in this example) to the group number G=1 of the original group OG. The date modifying unit 116 changes non-dot print data, in the dummy group DG1 at the nozzle position $N_\beta$, into dot-print data for printing the corrected next-to-end ink particle β'.

The data modifying unit 116 then outputs the modified original group OG, the modified dummy group DG1 the modified dummy group DG2, and the unmodified dummy group DG3, in this order (that is, the order of the group numbers G=1 to 4), to the signal supplying unit 118. The signal supplying unit 118 produces four successive voltage signals rows V1–V4, based on the received successive groups OG, DG1, DG2, and DG3, in synchronization with the timings when the nozzle plate 3 ejects four successive ink particle rows R1–R4. As a result, the four successive ink particle rows R1–R4 are controlled by the modified four successive print data groups OG, DG1, DG2, and DG3, thereby printing a desired straight line with no bend end portions.

Thus, according to the above-described embodiment and modifications, the ink jet printer 1 uses an earlier or later ejection timing for ink particles intended to form the end regions of a straight line, than the ejection timing of ink particles intended to form the center region of the straight line, in order to correct printing variations occurring in the end regions of the straight line. The number of corrected ink particles in each end region may be two or less. Thus, by using separate ink particles α' (and β') in place of ink particles α (and β) on either end of a straight line that is parallel to the row of ink nozzles 30, it is possible to correct for the deviations in the end portions of the straight line.

<Third Modification>

Next will be described a third modification of the above-described embodiment.

In the above-described embodiment and the second modification, three dummy print data groups DG1–DG3 are added before or after each original group of print data. However, any number of dummy print data groups DG may be added to each original print data group. In this case, the shift amounts $Q_\alpha$ and $Q_\beta$ may be selected among the value of one (1) to the value of the total number of the dummy print data groups DC, based on the experimental results, <Fourth Modification>

Next will be described a fourth modification of the above-described embodiment.

In the above-described embodiment, the dummy data adding unit 113 is provided in the controller 11. However, the dummy data adding unit 113 may be omitted. In this case, the data modifying unit 116 is designed to perform the modifying operation only onto the original group OG. Accordingly, the data modifying unit 116 modifies straight-line-end data and next-to-end data, looted at the nozzle positions $N_\alpha$ and $N_\beta$ in the original group OG, into non-dot print data.

The signal supplying unit 118 is designed to produce a voltage signal group V4 based on the modified original group OG, and to further produce three additional voltage signal groups V1–V3. The signal supplying unit 118 sets the group numbers G of the voltage signal groups V1–V4 to G=1 to 4. The signal supplying unit 118 selects, as a group for correcting for the end ink particle α, the voltage signal group V2, by determining the group number G=2 by subtracting the first shift amount $Q_\alpha$ (2) from the group number G=4 of the signal group V4. The signal supplying unit 118 further selects, as a group for correcting for the end ink particle β, the voltage signal group V3 by determining the group number G=3 by subtracting the first shift amount $Q_\beta$ (1) from the group number G=4 of the signal group V4. The signal supplying unit 115 produces the voltage signal groups V1–V3 so that the voltage signal group V1 includes negative value voltage signals at all the nozzle locations, the voltage signal group V2 includes a zero voltage signal at the nozzle position $N_\alpha$ and negative value voltage signals at the other remaining nozzle locations, and the voltage signal group V3 includes a zero voltage signal at the nozzle position $N_\beta$ and negative value voltage signals at the other remaining nozzle locations. After thus producing the voltage signal groups V1–V3, the signal supplying unit 118 produces the voltage signal group V4. The signal supplying unit 118 outputs the produced voltage signals groups V1–V4 in succession.

As described above, according to the above-described embodiment and modifications, ink particle(s) which start flying toward the printing medium P earlier than or later than the ink particles for the line central area is used as ink particle(s) for the line end. Accordingly, it is possible to compensate for the affects of electrical charges onto the flying path of the particle(s) for the line end portion, reducing the amount of bending at the end of the printed line such that the bend is not noticeable, thereby improving the quality of printing to satisfy consumer demands.

While the invention has been described in detail with reference to the specific embodiment thereof, it would be apparent to those skilled in the art that various changes and modifications may be made therein without departing from the spirit of the invention.

For example, in the above-described embodiment, the ink catcher 5 is applied with an electric voltage of a polarity opposite to that of the ink particles 8 which are electrically charged by the charge plate 4. However, the ink catcher 5 may be applied with no electric voltage. Still in this case, the charge plate 4, which is applied with an electric voltage of the polarity opposite to that of the charged ink particles 8, can electrostatically attract the charged particle 8 in a direction toward the charge plate 4. Accordingly, the charged particle 8 will fly along an ink flying path, which is slightly deflected in a direction toward the charge plate 4. By locating the ink catcher 5 at a location where the deflected ink flying path passes or intersects, the deflected ink particle will reach the ink catcher 5 to be collected thereby.

In the above-described embodiment, the single piezoelectric element (not shown) is provided in the resonance ink chamber. However, a plurality of piezoelectric elements may be provided in the resonance ink chamber if they drive oscillations at the same phase.

In the above-described embodiment, the nozzle plate 3 confronts vertically downwardly to elect ink particles vertically downwardly so that ink particles will be deposited on the printing medium P that is located below the print head 1. It can therefore be ensured that non-charged ink particles fly vertically downwardly due to gravitational forces applied thereto. However, the present invention can be applied to any type of continuous inkjet printer wherein the print head elects ink particles in any directions to allow the ink particles to be deposited on the printing medium that is located confronting the print head and that moves relative to the print head.

What is claimed is:

1. A continuous inkjet printer, comprising:

a continuous print head having a row of ejection nozzles, the row of ejection nozzles including a plurality of ejection nozzles which are arranged to be located at a plurality of nozzle positions defined along a first predetermined direction, the row of ejection nozzles being located at a predetermined position along a second predetermined direction that is substantially perpendicular to the first predetermined direction, each ejection nozzle ejecting successive ink particles continuously in a third predetermined direction that is substantially perpendicular to both of the first and second predetermined directions, thereby allowing the ejection nozzle row to eject successive rows of ink particles continuously in the third predetermined direction;

a conveying unit conveying a printing medium relative to the continuous print head in the second predetermined direction;

a deflecting unit receiving successive groups of control data, and selectively deflecting the ink particles in the successive ink particle rows, based on the received successive control data groups, thereby selectively preventing the ink particles from reaching the printing medium;

a judging unit receiving a print data group for one of the successive ink particle rows, and judging whether or not the print data group includes straight-line-end data indicative of an end portion of a straight-line that extends in the first predetermined direction; and a control data producing unit producing, when the print data group is judged to include the straight-line-end data at some nozzle position, deflection control data for deflecting an ink particle at the subject nozzle position in the subject ink particle row and producing first non-deflection control data for failing to deflect a first ink particle at the subject nozzle position in a first ink particle row that is different from the subject ink particle row.

2. A continuous inkjet printer as claimed in claim 1, wherein the print data group includes a plurality of sets of print data in correspondence with the plurality of nozzle positions, each paint data being either one of dot-print data and non-dot print data, the straight-line-end data being comprised from dot-print data, and wherein the control data producing unit produces one group of control data based on the print data group, by producing the deflection control data based on the straight-line-end data, by producing non-deflection control data based on the dot-print data other than the straight-line-end data, and producing deflection control data based on the non-dot print data.

3. A continuous inkjet printer as claimed in claim 2, wherein the judging unit includes:

a first determining unit determining whether dot-print data are arranged in the group of print data at three or more adjacent nozzle positions and whether non-dot print data is located at one or more nozzle position adjacent to the three or more adjacent nozzle positions; and a second determining unit determining, as the straight-line-end data, dot-print data that is located in one of the three or more adjacent nozzle positions and that is located directly adjacent to the non-dot print data at the one or more nozzle position.

4. A continuous inkjet printer as claimed in claim 2, wherein the control data producing unit includes:

a data receiving unit receiving the print data group;

a dummy data adding unit adding several duty groups of print data to the print data group, each dummy print data group being comprised of a plurality of non-dot print data in correspondence with the plurality of nozzle positions;

a data modifying unit modifying, when the print data group is judged to include the straight-line-end date at the some nozzle position, the straight-line-end data into non-dot print data, the data modifying unit further modifying non-dot print data, at the subject nozzle position in one of the several dummy print data groups, into dot-print data; and a control data generating unit generating one control data group based on the print data group and several control data groups based on the several dummy print data groups, the control data generating unit outputting the one control data group and the several control data groups to the deflecting unit as the successive control data groups.

5. A continuous inkjet printer as claimed in claim 2, wherein the deflecting unit includes a plurality of electrodes, which are located in correspondence with the plurality of nozzle positions and which are located in one side of the predetermined position with respect to the second predetermined direction, each electrode being applied with corresponding control data in the control data group, the deflection-control data in the control data group including a voltage signal of a predetermined polarity, the non-deflection control data in the control data group including a zero voltage signal, whereby the plurality of electrodes, upon receipt of the control data group, selectively electrically charge the ink particles in the corresponding ink particle row to a polarity opposite to the predetermined polarity, and electrostatically attracting the electrically-charged ink particles in a direction toward the plurality of electrodes.

6. A continuous inkjet printer as claimed in claim 5, wherein the deflecting unit further includes a collecting unit, located in the downstream side of the plurality of electrodes in the third predetermined direction, for receiving and collecting the electrically-charged ink particles attracted by the plurality of electrodes.

7. A continuous inkjet printer as claimed in claim 6, wherein the collecting unit is applied with an electric voltage of a polarity opposite to that of the electrically-charged ink particles, thereby electrostatically attracting the electrically-charged ink particles in a direction toward the collecting unit.

8. A continuous inkjet printer as clamed in claim 1, wherein the deflecting unit has a structure for deflecting, in response to the deflection-control data in the control data group, a corresponding ink particle in the corresponding ink particle row in a direction opposite to the second predetermined direction, the first ink particle row being ejected from the ejection nozzle row earlier than the subject ink particle row.

9. A continuous inkjet printer as claimed in claim 1, wherein the deflecting unit has a structure for deflecting, in response to the deflection-control data in the control data group, a corresponding ink particle in the corresponding ink particle row in a direction the same as the second predetermined direction, the first ink particle row being ejected from the ejection nozzle row later than the subject ink particle row.

10. A continuous inkjet printer as claimed in claim 1, wherein the print data group, judged to include the straight-line-end print data, further includes next-to-end data in one next-to-end nozzle position that is directly adjacent to the subject nozzle position for the straight-line-end print data, the next-to-end data indicating a part of the straight line adjacent to the end portion, and wherein the control data producing unit further produces deflection control data for deflecting another ink particle at the next-to-end nozzle position in the subject ink particle row and produces non-deflection control data for failing to deflect a second ink particle at the next-to-end nozzle position in a second ink particle row that is different from the subject ink particle row.

11. A continuous inkjet printer as claimed in claim 10, wherein the second ink particle row is different from the first ink particle row.

12. A continuous inkjet printer as claimed in claim 11, wherein the deflecting unit has a structure for deflecting, in response to the deflection-control data in the control data group, a corresponding ink particle in the corresponding ink particle row in a direction opposite to the second predetermined direction, the first ink particle row being ejected from the ejection nozzle row earlier than the second ink particle row, the second ink particle row being ejected from the ejection nozzle row earlier than the subject ink particle row.

13. A continuous inkjet printer as claimed in claim 11, wherein the deflecting unit has a structure for deflecting, in response to the deflection-control data in the control data group, a corresponding ink particle in the corresponding ink particle row in a direction the same as the second predetermined direction, the first ink particle row being ejected from the ejection nozzle row later than the second ink particle row, the second ink particle row being ejected from the ejection nozzle row later than the subject ink particle row.

14. A method of printing a straight line with a continuous inkjet printer, the continuous inkjet printer including a continuous print head, a conveying unit, and a deflecting unit, the continuous print head having a row of ejection nozzles, the row of election nozzles including a plurality of ejection nozzles which are arranged to be located at a plurality of nozzle positions defined along a first predetermined direction, the row of ejection nozzles being located at a predetermined position along a second predetermined direction that is substantially perpendicular to the first predetermined direction, each ejection nozzle ejecting successive ink particles continuously in a third predetermined direction that is substantially perpendicular to both of the first and second predetermined directions, thereby allowing the ejection nozzle row to eject successive rows of ink particles continuously in the third predetermined direction, the conveying unit conveying a printing medium relative to the continuous print head in the second predetermined direction, the deflecting unit receiving successive groups of control data, and selectively deflecting the ink particles in the successive ink particle rows, based on the received successive control data groups, thereby selectively preventing the ink particles from reaching the printing medium, the method comprising the steps of:

receiving a print data group for one of the successive ink particle rows;

judging whether or not the print data group includes straight-line-end data indicative of an end portion of a straight-line that extends in the first predetermined direction; and producing, when the print data group is judged to include the straight-line-end data at some nozzle position, deflection control data for deflecting an ink particle at subject nozzle position in the subject ink particle row and producing first non-deflection control data for failing to deflect a first ink particle at the subject nozzle position in a first ink particle row that is different from the subject ink particle row.

15. A method as claimed in claim 14, wherein the print data group, judged to include the straight-line-end print data, further includes next-to-end data in one next-to-end nozzle position that is directly adjacent to the subject nozzle position for the straight-line-end print data, the next-to-end data indicating a part of the straight line adjacent to the end portion, and further comprising the step of producing deflection control data for deflecting another ink particle at the next-to-end nozzle position in the subject ink particle row and produces non-deflection control data for failing to deflect a second ink particle at the next-to-end nozzle position in a second ink particle row that is different from the subject ink particle row.

16. A method as claimed in claim 15, wherein the second ink particle row is different from the first ink particle row.

* * * * *